United States Patent [19]

Decker

[11] 4,198,170

[45] Apr. 15, 1980

[54] SINGLE ELEMENT TYPING FOR LEFT TO RIGHT OR RIGHT TO LEFT LETTER FEEDING

[75] Inventor: Herbert Decker, Lauf, Fed. Rep. of Germany

[73] Assignee: Triumph Werke Nurnberg A.G., Nuremberg, Fed. Rep. of Germany

[21] Appl. No.: 898,957

[22] Filed: Apr. 21, 1978

[30] Foreign Application Priority Data

May 13, 1977 [DE] Fed. Rep. of Germany ..... 2721654

[51] Int. Cl.[2] ..... B41J 19/00

[52] U.S. Cl. ..... 400/323; 400/335; 74/37; 400/320

[58] Field of Search ..... 400/314.6, 317.3, 320, 400/320.1, 323, 323.1, 328, 332, 335, 336.1; 74/37

[56] References Cited

U.S. PATENT DOCUMENTS

| | | | |
|---|---|---|---|
| 2,490,035 | 12/1949 | Deakin | 74/37 |
| 2,847,859 | 8/1958 | Lynott | 400/317.3 X |
| 2,911,835 | 11/1959 | Smith | 74/37 |
| 2,939,321 | 6/1960 | Shovic | 74/37 X |
| 2,977,808 | 4/1961 | Dobbs | 74/37 |
| 3,029,649 | 4/1962 | Steyh | 74/37 |
| 3,572,489 | 3/1971 | Schaefer | 400/320 X |
| 4,084,681 | 4/1978 | Heinzl et al. | 400/320 X |

FOREIGN PATENT DOCUMENTS

| | | | |
|---|---|---|---|
| 373438 | 7/1939 | Italy | 74/37 |

OTHER PUBLICATIONS

IBM Technical Disclosure Bulletin, "Proportional Spacing and Justification," Hickerson, vol. 8, No. 5, Oct. 1965, pp. 781–782.

*Primary Examiner*—Ernest T. Wright, Jr.
*Attorney, Agent, or Firm*—Joseph R. Spalla

[57] ABSTRACT

A carriage supporting a single type element is couplable either to the upper run or the lower run of a looped cable drive system for left or right or right to left letter feeding movement under control of an escapement pawl carrier associated with a unidirectional control rack and driven by the upper run of the cable drive system.

3 Claims, 2 Drawing Figures

Fig_1
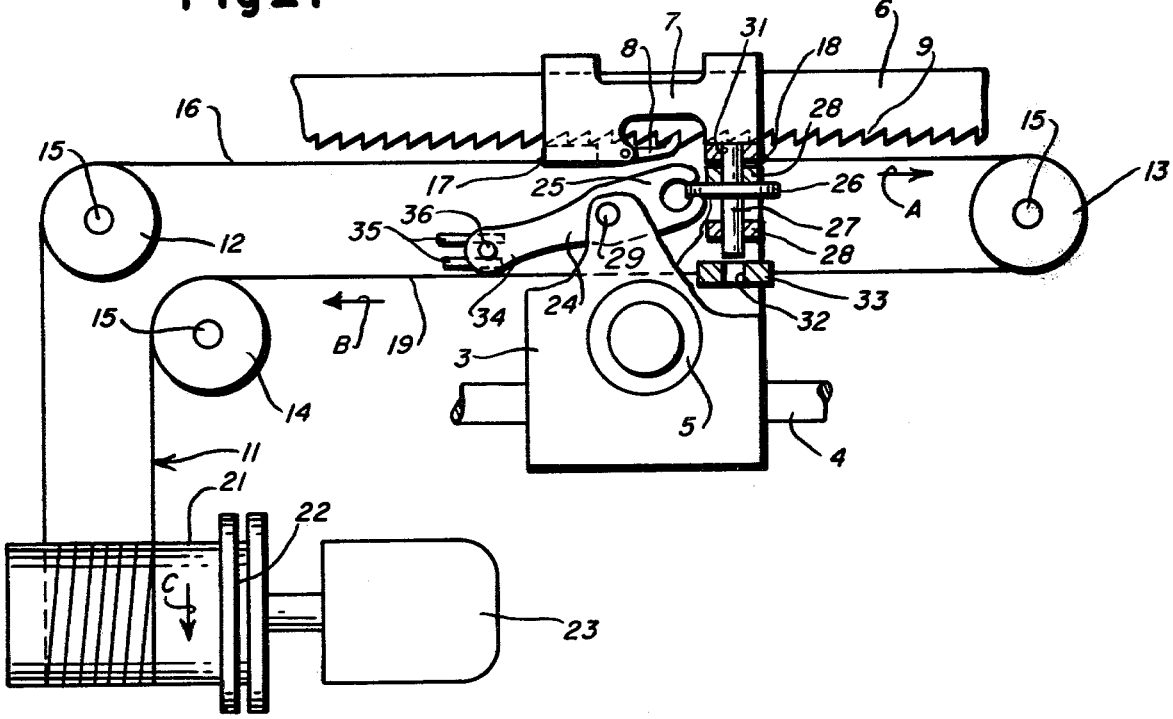
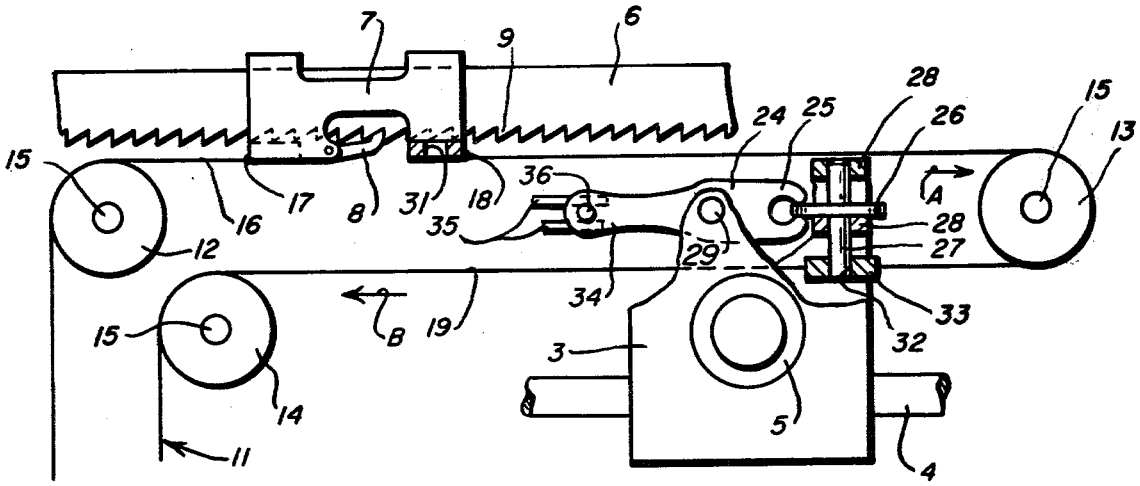
Fig_2

SINGLE ELEMENT TYPING FOR LEFT TO RIGHT OR RIGHT TO LEFT LETTER FEEDING

This invention relates to single element typewriters; more particularly, it relates to a single element typewriter having an escapement pawl carrier separate from the single type element carrier connected for unidirectional letter feeding movement to a cable drive system; and specifically, it relates to means for coupling the single type element carrier to said escapement pawl carrier or to a run of the cable drive system moving opposite the cable driven escapement pawl carrier.

Known single element typewriters can easily accomodate a variety of different style type fonts for use in the production of writings in left to right reading languages.

To accommodate fonts such as are used to produce writings in right to left reading languages, however, requires more than a simple font change. It requires mechanism changes as will permit letter feeding movements in right to left directions.

In the case of known typewriters, this poses a significant redesign problem; not only to provide a reversal of the writing direction to right to left, but also to changes of significance of certain operational keys, such as the tabulator key, return key, etc. As a rule, when reversing from one to the other writing direction, a change must also be made in specific operative key drives. Therefore, these machines become rather complicated in their construction and consequently also expensive.

In accordance with the invention, a carriage supporting a single type element is couplable either to the upper run or the lower run of a looped cable drive system for left to right or right to left letter feeding movement under control of an escapement pawl carrier associated with a unidirectional control rack and driven by the upper run of the cable drive system.

A particularly outstanding feature of the invention resides in the fact that it is not necessary to change the significance of certain operational keys following reversal of letter feeding direction so that the construction of such a machine, as compared to a standard typewriter, need not be changed substantially.

An object of the invention is to provide a single element typewriter which permits typing from left to right, or vice versa, of very simple design.

Other objects, features and advantages of the present invention will become known to those skilled in the art from a reading of the following detailled description when taken in conjunction with the accompanying drawing wherein like reference numerals designate like or corresponding parts throughout the several views thereof, and wherein:

FIG. 1 schematically shows the main parts of a single element typewriter set for left to right typing; and FIG. 2 is a view similar to FIG. 1 with the parts set for right to left typing.

Referring now to the drawing, there is shown a single element type body carriage or carrier 3 guided in the usual manner on a guide shaft 4 for movement along the typing line. Carriage 3 carries a single type element body 5, which, in the usual manner, can be selected according to the symbols which are to be typed. The single type element or font 5 is interchangeably attached in conventional manner known to the art and may be in the form of a ball, cylinder or prism. A single escapement rack 6 slidably supports an escapement pawl carrier 7 which has a pawl 8 which operates step by step in letter feeding direction in known manner in conjunction with the teeth 9 of the rack 6.

A looped cable generally designated by reference numeral 11 is guided over deflecting rollers 12, 13 and 14 which are rotatably supported in pivots 15 fixed in the machine frame. The cable 11 extending between rollers 12 and 13 defining an upper run 16 is secured as at 17 and 18 to opposite ends of the escapement pawl carrier 7. The cable 11 extending between deflecting rollers 13 and 14 define a lower run 19. The cable 11 is also wound about a spring powered drum or cable winch 21 wherein resides a spring (not shown) to urge the escapement pawl carrier 7 in letter feeding direction A for step by step advance incident to each printing under control of the pawl 8 and rack 6.

To effect carriage return movement of the escapement pawl carrier 7, a carriage return clutch 22 is engaged to couple a motor 23 to wind the drum 21 oppositely to and to wind or tension the spring therein as is conventional.

The single type element carrier 3 pivotally supports as at 29 a switching lever 24 intermediate its ends. One end 25 is forked to embrace a flange 26 on a bolt 27 which is axially movable in spaced bearings 28 supported on the single element carriage 3. This bolt 27 may be selectively positioned to enter into an opening 31 in the escapement pawl carrier 7 (as shown in FIG. 1) or into an opening 32 of a coupling piece 33 (as shown in FIG. 2) connected in the lower run 19 of the cable 11. Selection or switchover from FIG. 1 to FIG. 2, or vice versa, is, of course. possible only when both openings 31 and 32 are directly opposite each other. This aligned position of the single type element carriage 3 and the escapement pawl carrier 7 can be indicated exactly by means of a marking.

In FIG. 1, bolt 27 is engaged into the opening 31 of the escapement pawl carrier 7. The escapement pawl carrier 7 is thus firmly coupled to the type body carriage 3. Therefore, incident to typing, pawl 8 will be temporarily disengaged from a tooth 9 of rack 6 and fall into the next tooth gap. Through this stepping motion, the spring force in cable winch 21 is temporarily released, so that the spring tension moves or pulls the upper run 16 of the cable 11 in the direction of arrow A. The lower run 19 of cable 11 then moves in the direction of arrow B and the cable 11 is wound around cable winch 21 in the direction of arrow C. The single type element carrier 3 and escapement pawl carrier 7 thus move together in the direction of arrow A to the end of the line. Upon activation of a carriage return key (not shown), clutch 22 is engaged and motor 23 turns the cable winch 21 and therewith the cable 11 in the opposite direction. The upper and lower runs 16 and 19 of the cable 11, therefore, also move counter to arrows A and B until the single type element carrier 3, together with the escapement pawl carrier 7, are at the beginning of the line.

To reverse the typing direction of the type body carriage 3, lever 24 is moved clockwise from the FIG. 1 position to move the bolt 27 into opening 32 of the coupling piece 33. This releases the single type element carrier 3 from the escapement pawl carrier 7 and connects it to the lower run 19 of the cable 11. Thereafter, upon typing, under the action of the spring in the cable winch 21, the escapement pawl carrier 7 continues to move step by step in the direction of arrow A. However, since the single type element carrier 3 is connected to the coupling piece 33 in the lower run 19 of cable 11, the single type element carrier 3 moves together with the coupling piece 33 in the direction of arrow B opposite to the escapement pawl carrier 7. Thus, it is possible to type from right to left in the manner of Oriental writing. Of course, first the appropriate single element type font 5 has to be mounted on the carrier 3.

As can be seen from the drawing, it is very easy with the device of the invention to reverse the direction of typing and operational keys have the same significance. This is done simply by having the single type element carrier 3 connected to the upper run 16 of the cable 11 and another time with the lower run 19. Further modifications are not necessary on the typewriter of the invention. Of course, devices other than the ones represented and described are also suitable for the coupling.

In accordance with the invention, lever 24 may be directly operated manually or by guiding a pin 36 on its end 34 opposite the forked end 25 between parallel tracks 35 arranged on the machine frame for movement between the FIG. 1 and FIG. 2 positions by suitable mechanism. Alternatively, depending on the construction of the respective typewriter, the lever 24 may be mounted on the escapement pawl carrier 7.

The invention claimed is:

1. A single element typewriter having bidirectional drive means to move a single element type carrier in letter feed and carriage return direction parallel to a writing line, comprising a closed loop cable system having parallel runs extending the length of a writing line, said loop being coupled to said bidirectional drive means, an escapement pawl carrier connected in one of said loop runs, connector means in the other of said runs, a single element font carrier supported for movement along a writing line, and means for selectively coupling said single element font carrier to said escapement pawl carrier or to said connector means.

2. A typewriter as recited in claim 1, said coupling means being mounted on said single element font carrier.

3. A typewriter as recited in claim 1, said coupling means comprising a bolt mounted on said single element font carrier for axial movement, and an opening in said escapement pawl carrier and in said lower run of said cable system for reception of said bolt.

* * * * *